US006749130B2

(12) United States Patent
Cotton

(10) Patent No.: US 6,749,130 B2
(45) Date of Patent: Jun. 15, 2004

(54) CHECK LINE VALVE FASTER VENTING METHOD

(75) Inventor: Clifford E. Cotton, Pontiac, IL (US)

(73) Assignee: Caterpillar Inc, Peoria, IL (US)

( * ) Notice: Subject to any disclaimer, the term of this patent is extended or adjusted under 35 U.S.C. 154(b) by 265 days.

(21) Appl. No.: 10/021,481

(22) Filed: Dec. 6, 2001

(65) Prior Publication Data

US 2002/0070285 A1 Jun. 13, 2002

Related U.S. Application Data

(60) Provisional application No. 60/254,184, filed on Dec. 8, 2000.

(51) Int. Cl.[7] ..... F02M 47/02

(52) U.S. Cl. ..... 239/89; 239/88; 239/96; 239/533.8; 239/5; 137/107

(58) Field of Search ..... 239/88, 89, 92, 239/95, 96, 533.8, 5; 123/506, 467, 472; 137/102, 107

(56) References Cited

U.S. PATENT DOCUMENTS

| | | | | |
|---|---|---|---|---|
| 2,470,717 A | | 5/1949 | Palumbo | |
| 3,332,407 A | | 7/1967 | Scott | |
| 3,481,542 A | | 12/1969 | Huber | |
| 3,669,360 A | | 6/1972 | Knight | |
| 3,680,782 A | | 8/1972 | Monpetit et al. | |
| 3,688,986 A | | 9/1972 | Guegan et al. | |
| 4,489,886 A | * | 12/1984 | Kato | 239/88 |
| 4,588,132 A | | 5/1986 | Neitz et al. | |
| 4,928,886 A | | 5/1990 | Kronberger | |
| 5,682,858 A | * | 11/1997 | Chen et al. | 123/467 |
| 5,833,146 A | | 11/1998 | Hefler | |
| 5,894,991 A | | 4/1999 | Edwards et al. | |
| 6,113,000 A | * | 9/2000 | Tian | 239/88 |

FOREIGN PATENT DOCUMENTS

NO 808206 5/1955

OTHER PUBLICATIONS

IC engine double atomiser fuel supply system 1993 Derwent Publications LTD.

* cited by examiner

*Primary Examiner*—Dinh Q. Nguyen
(74) *Attorney, Agent, or Firm*—Michael Huber; Steve D. Lundquist

(57) ABSTRACT

A valve unit having a needle valve member, a control valve, a control line extending between the control valve and the needle valve member. Pressurized actuation fluid may be applied to the needle valve member via the control valve and the control line, in order to bias the needle valve member in a first direction. A vent passage is provided, which is fluidly connected to the control line between the needle valve member and the control valve. A valve element which is movably disposed in the control line and has a first position in which said vent passage is closed, and a second position in which said vent passage is open to the control line.

25 Claims, 1 Drawing Sheet

CHECK LINE VALVE FASTER VENTING METHOD

This application claims the benefit of prior provisional patent application Serial No. 60/254,184 filed Dec. 8, 2000.

TECHNICAL FIELD

The present invention relates to a valve unit and a method for controlling a biasing force acting on a valve element, and more particularly to applying a pressurized fluid to a control passage via a control unit, in order to bias the valve element to a first position. In particular, the invention relates to a valve unit of a fuel injector.

BACKGROUND

One such fuel injector is for example shown in U.S. Pat. No. 5,833,146 filed on Nov. 10, 1998 which is assigned to the assignee of the present invention. In the known fuel injector, fuel is pressurized to a high pressure via an intensifier piston and then supplied to a nozzle chamber in which a needle valve member reciprocates for opening and closing an injection nozzle. The needle valve member has a hydraulic surface on which the pressurized fuel acts. The surface is arranged such that the fuel applies a force to the needle valve member, thereby moving the needle valve in an opening direction. The needle valve member is biased in a closing direction by a compression spring. The pressure which is applied to the needle valve member by the fuel is capable of moving the needle valve member in the opening direction against the biasing force of the compression spring.

The needle valve member is also biased in the closing direction by a pressurized actuation fluid which acts on a piston contacting the needle valve member. The pressurized actuation fluid is applied to the piston which is arranged in a piston chamber of the injector body via a control line and a pilot valve. The cross sectional area of the piston surface, on which the pressurized actuation fluid acts is substantially larger than the cross sectional area of the surface on the needle valve member on which the pressurized fuel acts. Thus, a relatively low actuation fluid pressure may hold the needle valve member in a closed position against the force of the high pressure fuel acting on the needle valve. The actuation fluid therefore controls opening and closing of the needle valve, since the fuel pressure acting on the needle valve is usually not capable of moving the needle valve against the pressure applied to the piston. The pilot valve is arranged at an opposite end of the fuel injector with respect to the needle valve member due to space restrictions.

In order to start an injection event, the pressure acting on the piston is lowered via the control line and the pilot valve. Due to the long length of the control line which acts as a throttle and a small cross sectional area of the exit opening at the pilot valve, the venting of the actuation fluid is slow and takes a long time. After reaching a predetermined pressure of the actuation fluid at the piston, the fuel pressure acting on the needle check valve is high enough to move the needle valve member in the opening direction to thus start injection of fuel. Closing, the needle valve member is accomplished by applying pressure on the piston via the pilot valve and the control line. If the fuel pressure falls below a certain level during injection, the needle valve member can also be closed by the biasing force of the spring.

In order to have accurate control of the injection events in an engine, it is important that the needle valve member is quickly opened. In the known injector this is not possible due to the long control line length and the small cross sectional area of the outlet opening in the pilot valve.

The present invention is directed to overcoming one or more of the problems as set forth above.

SUMMARY OF THE INVENTION

In one aspect of the present invention a valve unit has a needle valve member, a control valve, a control line between the control valve and the needle valve member, wherein pressurized actuation fluid may be applied to the needle valve member via the control valve and the control line, in order to bias the needle valve member in a first direction, a vent passage which is connected to the control line between element needle valve member and the control valve and a valve element which is movable in the control line between a first position in which said vent passage is closed, and a second position in which said vent passage is open to the control line.

In another aspect of the present invention a fuel injector has an injector body defining a nozzle chamber having at least one injection nozzle, a hydraulic unit for pressurizing fuel in a the nozzle chamber, a needle valve member, which is movable between a first position in which the at least one injection nozzle is closed and a second position in which the at least one injection nozzle is open, a control valve, a control line extending between the needle valve member and the control valve, wherein pressurized fluid may be applied to the control line via the control valve, for biasing the needle valve member to its first position, a vent passage, which is connected to the control line between the needle valve member and the control valve, and a valve element, which is disposed in the control line and is movable between a first position blocking the fluid connection between the vent passage and the control line, and a second position opening fluid connection between the vent passage and the control line. The position of the valve element is controllable by pressure applied to the control line via the control valve.

In yet another aspect of the invention, a method for controlling the biasing force acting on needle valve member is provided. The method comprises the following steps: applying a pressurized fluid to the needle valve member via a control valve and a control line arranged between the control valve and the needle valve member for biasing the needle valve member in a first direction, venting at least part of the fluid via the control valve and lowering the biasing force, venting at least part of the fluid via a vent passage which is fluidly connected to the control line between the control valve and the needle valve member, the connection being opened by a valve element disposed in the control line in response to said partial venting of the pressurized fluid via the control valve.

DETAILED DESCRIPTION

Figure 1:
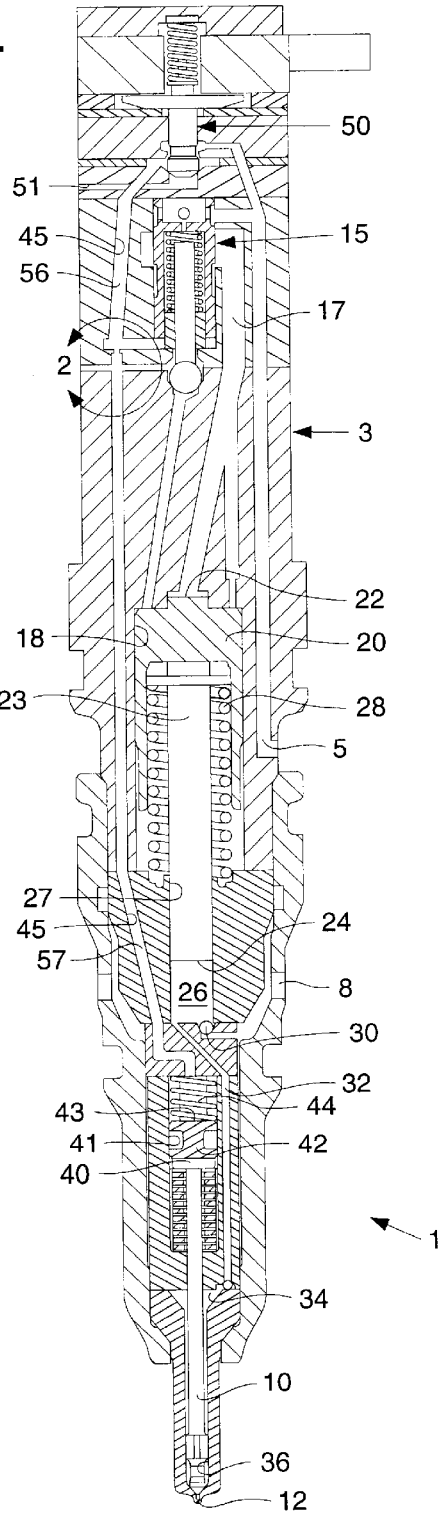
FIG. 1 is a diagrammatic sectioned side of elevational view of a fuel injector according to an embodiment of the present invention.

FIG. 1 shows a fuel injector 1 which is used in an internal combustion engine not shown for injecting fuel into a combustion chamber of the engine. The injector 1 has an injector body 3 which is formed of several parts. The injector body 3 has an actuation fluid inlet passage 5 which is connected to a source of a high pressure actuation fluid, such as lubricating oil. The body 3 also has an actuation fluid drain not shown, which is connected to a low pressure actuation fluid recirculation line. A fuel inlet 8 of the body 3 is connected to a source of fuel.

The injector 1 uses a hydraulic force applying system, such as a pump and controls the actuation fluid coming through the actuation fluid inlet passage 5 for pressurizing fuel in the injector before and during an injection event, respectively, as will be described in more detail herein below. The injector 1 also uses the actuation fluid for controlling movement of a needle valve member 10 which controls opening and closing of a fuel injection nozzle 12, formed in the injector body 3.

The hydraulic force applying system for pressurizing the fuel has an intensifier valve 15 for opening and closing a passage between the actuation fluid inlet passage 5 and an actuation line 17. The intensifier valve 15 is also capable of connecting the actuation line 17 to the actuation fluid drain. The actuation line 17 opens to a stepped piston bore 18, in which an intensifier piston 20 is moveable in a reciprocating manner. The intensifier piston 20 has a stepped end surface 22 facing towards the actuation line 17 and thus actuation fluid may be applied to the end surface 22 via the intensifier valve 15 and actuation line 17. The intensifier piston 20 is in contact with a second piston 23 which has an end surface 24 facing away from the intensifier piston 20 and faces a fuel chamber 26 formed in the injector body 3. The fuel chamber 26 is connected to the fuel inlet 8 via a ball valve 30. The second piston 23 is guided in a respective piston bore 27 of the injector body 3 and reciprocates therein. The cross sectional area of the surface 24 of the second piston 23 is substantially smaller than the cross sectional area of the stepped surface 22 of the intensifier piston 20. The second piston 23 is biased against the intensifier piston 20 by a spring 28 and is thus movable therewith. Even though the intensifier piston 20 and the second piston 23 are shown and described as separate elements, it is also possible to form these two elements integrally.

The fuel chamber 26 is connected to a first end of a nozzle chamber 34 via a line 32. The fuel nozzle 12 is formed at the other end of the nozzle chamber 34, and the needle valve member 10 is reciprocally disposed in the nozzle chamber 34 for opening and closing the fuel nozzle. The needle valve member 10 has a hydraulic surface 36 which is arranged such that pressurized fluid in the nozzle chamber 34 which acts on the hydraulic surface 36, urges the needle valve member 10 away from the fuel nozzle 12 for opening the fuel nozzle 12.

An end portion 40 of the needle valve member 10, facing away from the fuel nozzle 12, is arranged in a piston bore 41 of injector body 3 and is contacted by a piston 42 which is also arranged in the piston bore 41. The piston 42 has a control surface 43, facing away from the end portion 40 of the needle valve member 10. The control surface 43 has a cross sectional area which is substantially larger than the cross sectional area of the hydraulic surface 36 on the needle valve member 10. A compression spring 44 is disposed in the piston bore 41, which contacts the control surface 43 of the piston 42 and urges the piston 42 towards the end portion 40 of the needle valve member 10, thereby biasing the needle valve member 10 into the closing direction. The portion of the piston bore 41, in which the compression spring 44 is arranged, is fluidly connected to a control line 45 through which pressurized actuation fluid may be supplied to the piston bore 41. Pressurized fluid in the piston bore 41 acts on the control surface 43 of the piston 42 and urges the piston 42 towards the end portion 40 of the needle valve member 10 as will be explained in more detail herein below.

The amount of pressurized fluid delivered to the control line 45 is controlled by a control valve 50 at the end of the control line 45 which is opposite to the piston bore 41. The control valve 50 is capable of connecting control line 45 with the actuation fluid inlet passage 5 for supplying pressurized actuation fluid to the control line 45. Control valve 50 is also capable of connecting control line 45 with a vent line 51 for venting actuation fluid from the control line 45 to an actuation fluid reservoir, not shown.

Figure 2:
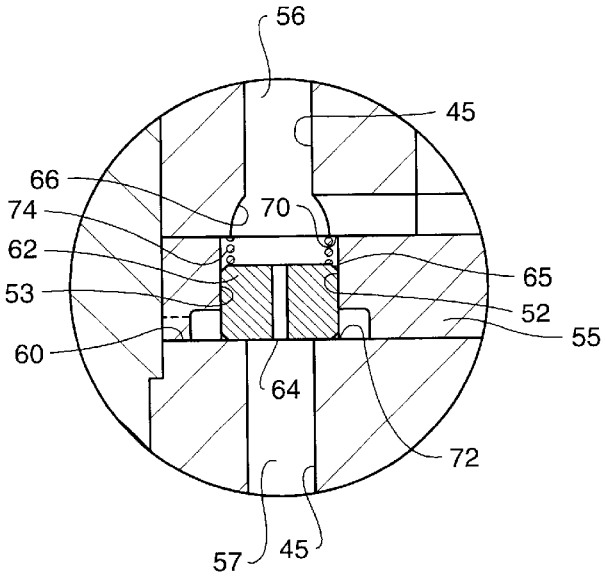
FIG. 2 is an enlarged diagrammatic partial sectioned side elevational view of the encircled portion of the fuel injector shown in FIG. 1.

The control line 45 has a broadened portion 52 as best shown in FIG. 2, which is arranged between control valve 50 and piston bore 41. The broadened portion 52 is formed by a through bore 53 in a plate 55 of the multi-part injector body 3. The broadened portion 52 divides the control line 45 into an upper section 56, extending between the control valve 50 and the broadened portion 52, and a lower section 57, extending between the broadened portion 52 and the piston bore 41. A vent passage 60 is provided in plate 55, and is fluidly connected to the broadened portion 52 of control line 45. The vent passage 60 is fluidly connected with a low pressure recirculation line, not shown, for recirculating the actuation fluid to the actuation fluid reservoir. A valve element 62 is provided within the broadened portion 52 of control line 45 and is movable in the axial direction of the control line 45. The valve element 62 has a through opening 64 having a cross sectional area which is smaller than the regular cross sectional area of control line 45. If desired, a plurality of through openings may be provided, wherein the sum of the cross sectional areas of the through openings is smaller than the cross sectional area of the control line 45.

The valve element 62 has beveled edges 65 at the upper and lower ends. The upper section 56 of the control line 45 comprises a broadening portion adjacent to the broadened portion 52 formed within the plate 55, as shown at 66. Even though not shown in FIG. 2, the broadening portion 66 may be symmetric with respect to a longitudinal axis of the control line 45. This ensures that the valve element 62 is pressurized evenly.

The valve element 62 is movable within the broadened portion 52 of the control line 45 between an upper 70 and a lower 72 abutment surface. In a first position, as shown in FIG. 2, the valve element 62 contacts lower abutment surface 72 and blocks the fluid connection between the vent passage 60 and the control line 45. In a second position, which is offset with respect to the position shown in FIG. 2, the valve element 62 contacts upper abutment surface 70 and the fluid connection between control line 45 and vent passage 60 is opened. In order to ensure good closing of the valve element 62, a biasing element 74, in particular a compression spring or any other resilient element is disposed between the valve element 62 and the abutment surface 70. The biasing element 74 thus biases the valve element 62 to the first position.

INDUSTRIAL APPLICABILITY

In operation and after a previous injection cycle, the spring 28 urges the second piston 23 and the intensifier piston 20 from an advanced position, not shown, to a retracted position as shown in FIG. 1. During retraction of the pistons 20 and 23, fuel flows into the fuel chamber 26 via the fuel inlet 8 and the ball valve 30. Thereafter, actuation fluid is supplied to the actuation line 17 via the intensifier valve 15. Due to the pressurized actuation fluid acting on the end surface 22, the intensifier piston 20 and thus the second piston 23 are moved downward against the biasing force of the spring 28. The pressure in the fuel chamber 26 increases and the ball valve 30 closes. Since the cross sectional area of the end surface 22 of the intensifier piston 20 is substantially larger than the cross sectional area of the end surface 24 of the second piston 23, the fuel in chamber 26 is pressurized to a substantially higher pressure than the pressure of the actuation fluid. The pressurized fuel is supplied from chamber 26 via the line 32 to the nozzle chamber 34 in which the needle valve member 10 is reciprocally disposed. The pressurized fuel pushes against the hydraulic surface 36 of the needle valve member 10 and urges the needle valve member 10 in the opening direction.

Pressurized actuation fluid in the piston bore 41 acts on a control surface 43 of the piston 42 and urges the piston 42 against the end portion 40 of the needle valve member 10 to thereby bias the needle valve member 10 into a closed position. The cross sectional area of the control surface 43 of piston 42, to which the actuation fluid is applied, is substantially larger than the cross sectional area of the hydraulic surface 36 of needle valve member 10, to which the pressurized fuel is applied. Thus, actuation fluid in the piston bore 41 holds the needle valve member 10 in a closed position even if the fuel pressure in the nozzle chamber 34 is substantially larger than the pressure of the actuation fluid in piston bore 41.

In order to start an injection cycle, control valve 50 vents actuation fluid from the upper section 56 of the control line 45. The pressure in the upper section 56 of control line 45 decreases faster than the pressure in the lower section 57 of control line 45, since the through opening 64 of the valve element 62 has a cross sectional area which is smaller than the regular cross sectional area of the control line 45. The through opening 64 thus acts as a throttle, which is arranged in the control line 45. Due to the higher pressure in the lower section 57 of the control line 45, the valve element 62 is urged upwards against the upper abutment surface 70, thereby opening the fluid connection between the vent passage 60 and the control line 45. Actuation fluid from the lower section 57 of control line 45 thus flows through vent passage 60, thereby shortening the vent distance for the portion of the pressurized actuation fluid in the lower section 57 of the control line 45.

After venting the actuation fluid from the piston bore 41, the piston 42 is biased against the end portion 40 of the needle valve member 10 by said compression spring 44 only. The pressure acting on the hydraulic surface 36 of needle valve member 10 is sufficient to overcome the biasing force of compression spring 44 and to move needle valve member 10 upwardly to open fuel injection nozzle 12. The needle valve member 10 remains in the open position until the pressure acting on the hydraulic surface falls below a predetermined pressure, which is not sufficient to overcome the biasing force of the compression spring 44 or until pressurized actuation fluid is reintroduced into the piston bore 41.

In order to reintroduce pressurized actuation fluid into the piston bore 41, actuation fluid is supplied to the upper section 56 of control line 45 via the control valve 50. The actuation fluid acts from above on the valve element 62 and urges the valve element 62 downwards to the closed position as shown in FIG. 2. Since the through opening 64 has a smaller cross sectional area than the control line 45, this area again acts as a throttle, generating a pressure difference between the upper 56 and lower 57 sections of control line 45. This pressure difference enables the valve element 62 to move against lower abutment surface 72. The movement is supported by the biasing element 74. The vent passage 60 is closed and pressurized actuation fluid is supplied to the piston bore 41 via the control valve 50, the upper section 56 of the control line 45, the valve element 62 and the lower section 57 of the control line 45. The pressurized fluid acts on the piston 42 and thereby closes the needle valve member 10. As described herein above, the valve element 62 is moved to its closed or opened position by pressure differences within the control line 45. The fuel injector 1 according to the present invention thus enables faster opening of the needle valve member 10 since the pressurized fluid in the piston bore 41 is partially vented via the vent passage 60 rather than the control valve 50. Thus, the pressure acting on the piston 42 is released faster than in the previous applications. Faster opening of the needle valve member 10 leads to a better control of the fuel injection cycle. Closing of the needle valve member 10, on the other hand, is slowed due to the restriction in the valve element 62. Slower closing of the needle valve member 10 reduces the impact of the needle valve member 10 on a corresponding valve seat of the fuel injection nozzle 12. Thus, stresses acting on the needle valve member 10 and its associated componentry are substantially lowered therefore enabling a longer service life of the needle valve member 10 and its associated componentry. The arrangement of the present invention enables opening and closing of the valve element 62 in a simple and cost-effective manner without requiring an additional drive unit. The present invention was described with respect to a preferred embodiment of the present invention without being limited thereto. The present invention is for example not limited to a fuel injector. The invention may be used in all valve units having relatively long control lines and in which fast venting of the control line is necessary. The broadened portion 52 of the control line may be positioned at a different location to the position in FIG. 1. Preferably it is positioned halfway between control valve 50 and piston bore 41. Other aspects, objects and advantages of the present invention can be obtained from a study of the drawings, the disclosure and the appended claims.

What is claimed is:

1. A valve unit comprising:

a needle valve member;

a control valve;

a control line extending between the control valve and the needle valve member, wherein a pressurized fluid being applied to the needle valve member via the control valve and the control line to bias the needle valve member into a first direction;

a vent passage fluidly connected to the control line between the needle valve member and the control valve; and a valve element disposed in the control line, and being moveable between a first position, at which the fluid connection between the vent passage and the control line is closed, and a second position, at which the fluid connection between the vent passage and the control line is opened, said valve element being controllably moveable between said first and second positions by pressurized fluid applied to the control line via the control valve.

2. The valve unit according to claim 1, wherein the valve element includes a through opening, said through opening opening at opposite ends of the valve element and into the control line.

3. The valve unit according to claim 2, wherein said through opening and the control line each have a predetermined cross sectional area and said cross sectional area of said through opening being smaller than the cross sectional area of the control line.

4. The valve unit according to claim 1, wherein the control line includes a broadened portion, in which the valve element is disposed and guided.

5. The valve unit according to claim 4, wherein said broadened portion includes abutment surfaces defining first and second positions of the valve element.

6. The valve unit according to claim 4, wherein said control line includes a further broadening portion adjacent to the broadened portion at an upper section of the control line extending between the control valve and the valve element.

7. The valve unit according to claim 6, wherein said broadening portion is symmetrically arranged with respect to a longitudinal axis of said control line.

8. The valve unit according to claim 1, further including a biasing element, said biasing element biasing said valve element towards its first position.

9. The valve unit according to claim 8, wherein said biasing element is a spring.

10. The valve unit according to claim 1, further including a compression spring, said compression spring biasing said needle valve member in said first direction independent of pressurized fluid in said control line.

11. The valve unit according to claim 10, wherein said needle valve member is biased in said first direction by at least one of said pressurized fluid and said compression spring.

12. The valve unit according to claim 1, wherein the valve unit is part of a fuel injector.

13. A fuel injector comprising:

a fuel injector body defining a nozzle chamber having at least one injection nozzle;

a needle valve member disposed in said nozzle chamber and being moveable between a first position, in which said at least one injection nozzle is closed and a second position, in which said at least one injection nozzle is open;

a control valve;

a control line extending between said needle valve member and said control valve, said control valve delivering pressurized fluid to said control line for biasing said needle valve member to its first position;

a vent passage disposed in said fuel injector body and being fluidly connected to said control line between said needle valve member and said control valve; and a valve element disposed in said control line and being reciprocally moveable between a first position, at which said valve element blocks the fluid connection between said vent passage and said control line and a second position, at which said valve element opens the fluid connection between said vent passage and said control line, said position of the valve element being controllable by pressurized fluid applied to said control line via said control valve.

14. The fuel injector according to claim 13, wherein the valve element includes at least one through opening, said through opening opening at opposite ends of said valve element and into said control line.

15. The fuel injector according to claim 14, wherein said through opening has a smaller cross sectional area than the control line.

16. The fuel injector according to claim 13, wherein the control line includes a broadened portion in which said valve element is disposed and guided.

17. The fuel injector according to claim 16, wherein said broadened portion includes abutment surfaces defining said first and second positions of said valve element.

18. The fuel injector according to claim 16, wherein said control line includes a further broadening portion adjacent to the broadened portion at an upper section of said control line, extending between the control valve and the valve element.

19. The fuel injector according to claim 18, wherein said further broadening portion is symmetric with respect to a longitudinal axis of said control line.

20. The fuel injector according to claim 13, wherein a biasing element is provided for biasing said valve element into its first position.

21. The fuel injector according to claim 20, wherein said biasing element is a spring.

22. The fuel injector according to claim 14, further including a compression spring for biasing said needle valve member into its first position independent of pressurized fluid in said control line.

23. A method for controlling the biasing force acting on a needle valve member, comprising the following steps:

applying a pressurized fluid to the needle valve member via a control valve and a control line arranged between said control valve and said needle valve member, for biasing said needle valve member in a first direction;

venting at least a part of said pressurized fluid via the control valve and lowering said biasing force; and venting at least part of said pressurized fluid via a vent passage having a fluid connection with said control line between said control valve and said needle valve member, said fluid connection being opened by a valve element disposed in said control line in response to said partial venting of pressurized fluid via the control valve.

24. The method according to claim 23, wherein the fluid pressure in said control line extending between said needle valve member and the control valve is increased in order to move said valve element to a position to close the fluid connection between said vent line and said control line.

25. The method according to claim 23, wherein a an additional pressurized fluid which acts opposite to said pressurized fluid is applied to a hydraulic surface of said needle valve member for urging said needle valve member in a second direction.

* * * * *